United States Patent [19]

Pascoe

[11] 3,963,203

[45] June 15, 1976

[54] AUTOMATIC CONTROL SYSTEM FOR RAILROAD INTERLOCKING

[75] Inventor: Frank T. Pascoe, Pittsburgh, Pa.

[73] Assignee: Westinghouse Air Brake Company, Swissvale, Pa.

[22] Filed: Jan. 30, 1975

[21] Appl. No.: 545,425

[52] U.S. Cl. ..... 246/134; 246/131; 246/219; 104/88

[51] Int. Cl.[2] ..... B61L 21/04

[58] Field of Search ..... 246/167 R, 131, 134, 246/253, 219; 104/88, 149, 153; 340/31 R, 36

[56] References Cited

UNITED STATES PATENTS

| | | | |
|---|---|---|---|
| 2,111,329 | 3/1938 | Vaughn | 246/134 |
| 2,207,108 | 7/1940 | Pelikan | 246/219 |
| 3,796,871 | 3/1974 | Helmcke | 246/167 R |
| 3,840,736 | 10/1974 | Asano | 246/167 R |

*Primary Examiner*—Trygve M. Blix
*Assistant Examiner*—Reinhard J. Eisenzopf
*Attorney, Agent, or Firm*—A. G. Williamson, Jr.; R. W. McIntire, Jr.

[57] ABSTRACT

Trains approaching the junction switch for two converging rail lines are detected by separate approach relays which repeat one or more track sections along each approach line. Each approach relay is reset when the train from the corresponding branch, as designated by switch correspondence relays, occupies the switch detector track section. The approach relays control the position of a magnetic stick sequencing relay. The reset of each approach relay by switch section occupancy assures the alternate positioning of the sequencing relay when successive trains simultaneously approach on both branches. The sequencing relay position selects a corresponding interlocking route relay which prepares and initiates the establishment of the route over the junction switch for the next train. Since the sequencing relay alternately operates to each of its positions, the route relays are alternately selected and trains thus alternately move from each approach branch line into the single track.

6 Claims, 1 Drawing Figure

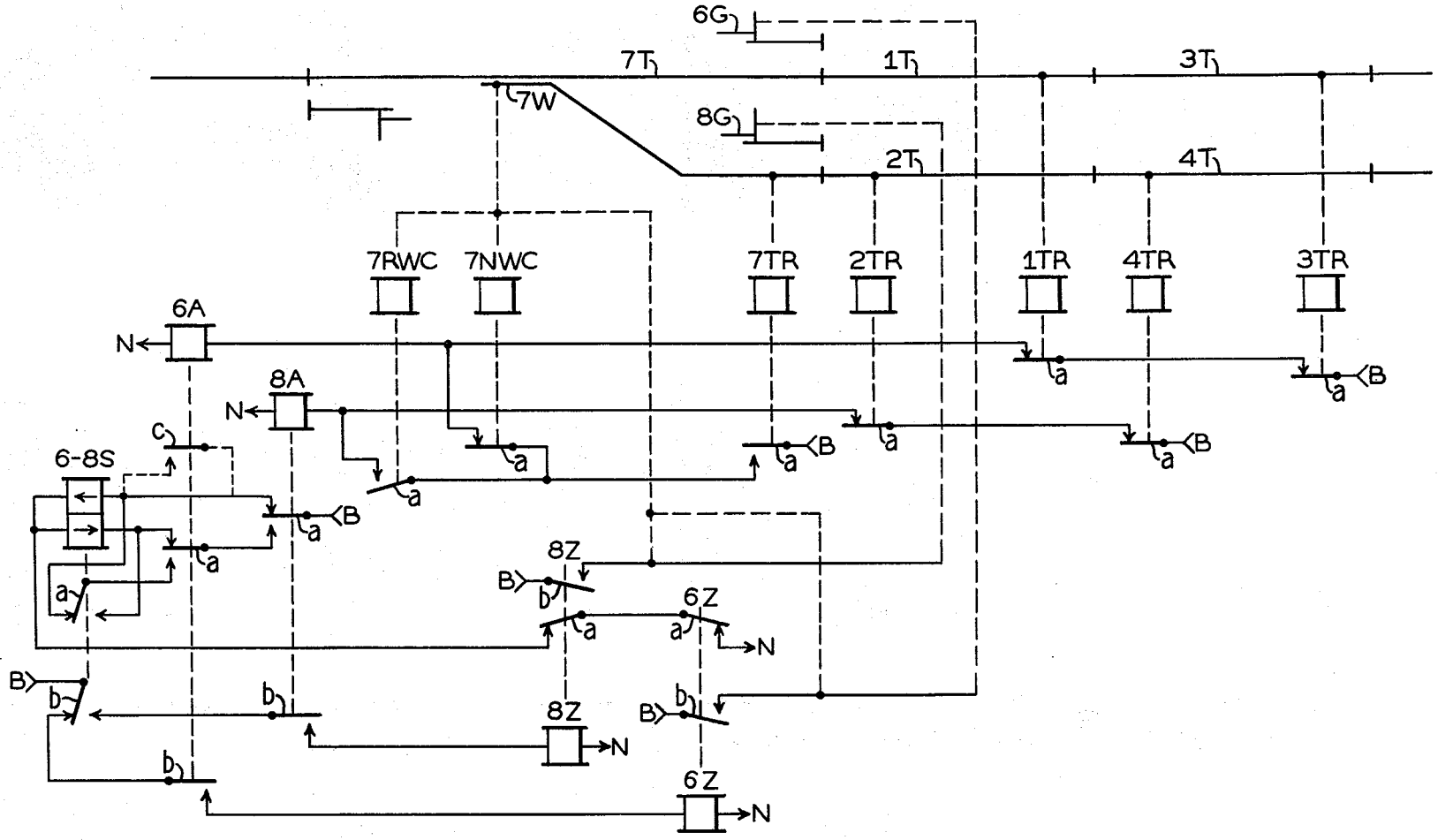
3T
4T
1T
2T
7T
6G
8G
7W
3TR
4TR
1TR
2TR
7TR
7NWC
7RWC
8A
6A
6-8S
6Z
8Z
N
B
a
b
c

AUTOMATIC CONTROL SYSTEM FOR RAILROAD INTERLOCKING

BACKGROUND OF THE INVENTION

My invention pertains to an automatic control system for a railroad interlocking. More specifically, the invention pertains to an automatic control system for alternating the movement of trains from two converging tracks into a single track stretch.

Frequently in rapid transit operation, trains from two branch line tracks converge into a single track stretch as they approach and enter a station area. Such trains approach under automatic signal control in the usual rapid transit system. In other words, these trains continue their forward movement along the branch lines in accordance with wayside signal indications which reflect advance traffic conditions and thus are not directly under the remote control of a system operator who therefore need not concern himself with the specific control of such approaching trains. The duties of the system operator can be further reduced if automatic control can be provided to position the switch at the junction point of the converging branch lines leading into the station area. The approaching trains then initiate a switch position control and the clearing of the station entering signal without requiring any specific, manual operations by the system operator. However, to maintain proper scheduling, it is frequently desirable to alternate trains from each branch line into the station. This creates no problem if sufficient headway exists to assure that only one train at a time approaches the junction switch location. Normally during rush hours, both approach tracks may be continuously occupied so that, unless special control provisions are provided, one route may hold in an established position to clear all trains from that branch line in succession. Therefore to meet the schedule and/or the operational requirements, the interlocking routes must be controlled to authorize approaching trains to enter the station alternately from the branch lines.

Accordingly, an object of my invention is an improved automatic interlocking control system for converging trains.

Another object of the invention is a control system for automatically alternating the movement of successive trains from two converging tracks over a junction switch into a single track stretch.

A further object of the invention is a system for automatically authorizing the alternate entry of trains from two branch tracks into a single track.

Still another object of my invention is a circuit arrangement which automatically clears alternate routes from two converging branch line tracks to a single track for trains successively approaching on both branch tracks.

It is also an object of my invention to provide an automatic interlocking control system for the junction switch of two converging tracks which alternately establishes routes from each track for trains successively approaching the junction location.

Other objects, features, and advantages of my invention will become apparent from the following specification when taken in connection with the accompanying drawing and appended claims.

SUMMARY OF THE INVENTION

In practicing my invention, approaching trains over each of two branch line tracks converging toward a junction switch are detected by a separate approach relay for each branch. As specifically shown, this approach relay repeats the track relays of one or more track circuits in each of the two approach sections but the detection in more or fewer approach track sections in each branch may be used. This approach detection relay is then reset when that train occupies the switch detector track section. In other words, when the track relay for the switch detector section releases as the train passes into the single track stretch, the approach relay which detected that train, selected in accordance with the position of the switch as repeated by the switch correspondence relays, is reset to its normal energized position. The required route for each approaching train is selected by a sequencing relay with the actual interlocking route relay being energized only if the approach relay also releases when the sequencing relay makes the route selection. The route relay sets up the controls to establish the route, that is, to position the switch and to then clear the entry signal authorizing the train to enter the single track stretch.

The sequencing relay is of the type which may be repositioned by reversing the polarity of its energizing current. The release of the corresponding approach relay to detect an approaching train positions the sequencing relay to select the route for that train. If a second train is then detected approaching along the other branch, the release of its corresponding approach relay holds the sequencing relay in its existing position. The reset of the first approach relay as the train enters the single track actuates a change in position by the sequence relay which selects the other route for the second train detected in the other approach section. Even though the first approach relay again releases, when the first train clears the switch detector section, in response to the approach of a following train in the same branch line, the route for the other track has already been selected and the train detected approaching therein is provided with a route and signal as soon as advance traffic conditions are proper. Thus as long as both approach sections are continuously occupied by successive trains, the sequencing relay is operated between its two positions by the pickup and release of the corresponding approach relays. This action alternately selects the routes from the converging tracks for the trains successively approaching along each branch line and assures that trains will be alternately sequenced into the station area from the two branch tracks.

DESCRIPTION OF THE ILLUSTRATED EMBODIMENT

I shall now describe in greater detail a specific interlocking control arrangement embodying my invention for alternating the movement of converging trains, with reference to the single accompanying drawing.

The single drawing FIGURE is a partly schematic, circuit diagram illustrating an automatic interlocking control system embodying the features of my invention.

In the drawing, conventional symbols known in the railway signaling art are used. All except one of the relays, conventionally shown, are of the simple direct current, neutral type which pick up to close front contacts when the winding is energized and released to close back contacts when the winding becomes deenergized. Any snubs on the relay windings necessary to provide circuit operation timing are considered to be part of the engineering development of any specific system and are thus not illustrated. The sequencing relay 6-8S is illustrated as a two winding, magnetic stick type relay. Such relays operate their contact armatures, shown in a vertical position, to the left to close normal contacts only if the energizing current flowing in either winding is in the direction of the arrow shown within that winding symbol. Conversely, if the energizing current flows through either winding in a direction opposite to the illustrated arrow, contacts close in the right or reverse position. When the windings are deenergized, the contacts remain in the position to which last operated. A source of direct current energy will be provided for operating the relays but it is not specifically shown. Any one of several types of direct current sources may be used and since such use is conventional, only connections to the positive and negative terminals of this source are designated by the reference characters B and N, respectively.

Across the top of the drawing figure is a schematic illustration of a simple railroad interlocking in which two separate branch tracks, each illustrated by a single line representation, approach from the right and converge through a switch 7W into a single track stretch extending to the left. Each of the approaching tracks is divided by insulated joints into track sections, 1T and 3T in the upper branch and 2T and 4T in the lower branch line. Each track section is provided with a conventional track circuit for the detection of trains. Since the operation of such track circuits is well known, only the track relay, connected to the rail symbol by a conventional dotted line, is illustrated in the drawing and is designated by the reference TR with a numerical prefix the same as that of the track section. Reviewing briefly, each such track relay, for example relay 2TR, is normally picked up, closing front contacts, and releases in response to the occupancy of the corresponding section by a train, the release of the relay opening front contacts. The detector track section 7T, set off by conventional insulated joints, includes the junction switch 7W and is provided with a track circuit for which the usual track relay 7TR is illustrated. Again, when any portion of this detector track circuit, that is, the two approach branch portions, the switch, or the single track part to the left insulated joint, is occupied by a train, relay 7TR releases to close back contacts. Under unoccupied conditions, relay 7TR remains picked up.

Entrance into the single track stretch over the junction switch is governed by the entry signals 6G and 8G which are illustrated by conventional symbols adjacent the left end of track sections 1T and 2T, respectively. A signal for reverse movements over the switch into either branch track is shown at the left of section 7T but it is not involved in the arrangement of my invention. Two switch correspondence relays 7RWC and 7NWC for indicating the position of switch 7W are shown. These relays respectively repeat the reverse and normal position of switch 7W, providing that its position is in accordance with that designated by the activated interlocking control route relay. Association of these relays with the switch points is indicated by a conventional dotted line representing the switch circuit controller device. Control functions, also designated by a conventional dotted line from the route relays, will be discussed later. Obviously only one of these relays is normally energized and the normal switch correspondence relay 7NWC is illustrated in this position. If the switch does not fully occupy either position or does not correspond with the required position, both relays are released.

A train approach detection relay A is provided for each branch line, the relay being further designated by a numerical prefix corresponding to that given to the signal which is associated with the branch line. Thus approach relay 6A is associated with the upper branch line and repeats the detection of trains by track relays 1TR and 3TR. In other words, relay 6A is normally energized by a simple circuit extending between terminals B and N and including front contacts *a*, in series, of relays 3TR and 1TR and the winding of relay 6A. A similar circuit for relay 8A includes front contacts *a* of relays 2TR and 4TR. Thus each approach relay is deenergized and releases when either of the track relays controlling its normal energizing circuit is released. Obviously fewer or more approach track sections, each having a track circuit with a track relay, can be used to control either of the approach relays depending upon the length of approach detection required. Each approach relay is provided with a reset circuit which includes a back contact *a* of relay 7TR, to designate the presence of a train in the switch detector section, and a front contact of the switch correspondence relay which repeats the position of the switch necessary for a train to leave the approach branch corresponding to the approach relay. Thus the reset circuit for relay 6A includes back contact *a* of relay 7TR and front contact *a* of relay 7NWC while the circuit for relay 8A includes front contact *a* of relay 7RWC.

The approach relays A control the sequencing relay 6-8S, the type and operation of which has been previously defined. The circuit for the upper winding of relay 6-8S extends from terminal B over front contact *a* of relay 8A, through the upper winding of the sequencing relay, and over back contacts *a* of route relays 8Z and 6Z to terminal N. Obviously the flow of current in this circuit is in the direction of the arrow shown in the upper winding of the sequencing relay so that the relay operates its contacts to close in the left or normal position. An alternate or holding circuit for this upper winding extends from the same terminal B over back contacts *a* of relays 8A and 6A, normal contact *a* and the upper winding of relay 6-8S, and thence over back contacts *a* of the route relays to terminal N. Again the flow of current is in the direction of the arrow so that this circuit holds the relay in its normal position and is useful if relay 8A releases when relay 6A is already released for a first train, as will become apparent from the following discussion.

The circuit for the lower windin g of relay 6-8S, with relay 6A picked up, includes back contact *a* of relay 8A, front contact *a* of relay 6A, the lower winding of the sequencing relay, and thence over back contacts *a* of the route relays Z to terminal N. Flow of current in this circuit is opposite to the arrow shown in the lower winding so that this energization of relay 6-8S causes it to move its contacts to the right or reverse position. If relay 6A should then release, the closing of its back contact *a* completes an alternate circuit further including reverse contact *a* of relay 6-8S which also energizes the lower winding of this latter relay in the reverse direction and holds it in its reverse position. It may be noted that if either route relay Z is picked up, all operating circuits for relay 6-8S are interrupted and the relay is completely deenergized. However, under these circumstances, since it is a magnetic stick relay, its contacts remain in the position to which last operated.

The route relays Z are controlled by a selective network in which the selection is made by contact *b* of relay 6-8S and the individual circuits are completed by a back contact of the corresponding approach relay A. Specifically, relay 6Z is energized by a circuit including normal contact *b* of relay 6-8S and back contact *b* of relay 6A while the circuit for relay 8Z is selected over reverse contact *b* of relay 6-8S and completed by back contact *b* of relay 8A. Obviously both route relays cannot be energized at the same time since one or the other is selected by the sequencing relay. The route relays individually prepare, initiate, and/or enable the control of the track switch and the clearing of the associated wayside signal to establish the route from a branch track into the single track stretch. This is illustrated by the front contacts *b* of relays 6Z and 8Z which separately extend by conventional dotted lines to the associated symbols for signals 6G and 8G, respectively, and jointly extend over the common dotted line to the track symbol for switch 7W. The dotted lines designate the conventional advance traffic controls by which a signal indication is selected and, for the switch, the track occupancy and position controls which are well known in the art. Thus further illustration of the specific controls for the signals and the track switch are considered unnecessary and are omitted.

I shall now describe the operation of the interlocking control arrangement embodying my invention starting with the conditions of the relays as illustrated in the drawing when no trains are occupying any of the approach sections or the switch detector section. It is then assumed that a first train approaches along the upper branch track and enters section 3T so that the corresponding track relay 3TR releases. The opening of front contact *a* of relay 3TR interrupts the circuit for and thus deenergizes relay 6A to register the detection of this approaching train. Since front contact *a* of relay 8A remains closed, relay 6-8S remains in its normal position with the upper winding energized by current flowing in the direction of the arrow. The closing of back contact *b* of relay 6A, when it releases, completes a circuit for energizing route relay 6Z. When this latter relay picks up, the opening of its back contact *a* interrupts the circuit for the upper winding of the sequencing relay but the relay contacts remain in their normal position as is typical for such magnetic stick type relays. The closing of front contact *b* of relay 6Z initiates the establishment of a route for the train detected approaching along the upper branch track. If not already in that position, switch 7W is operated to its normal position and signal 6G is cleared to authorize the train to enter the single track stretch, the actual signal indication depending upon the advance traffic condition beyond the switch section to the left of the drawing. There is no change when this train enters section 1T since the opening of front contact *a* of relay 1TR only further interrupts the usual circuit for relay 6A.

I shall now assume that a second train enters section 4T. The release of relay 4TR in response to the detection of this train interrupts the circuit for relay 8A which then releases. With back contact *a* of relay 6Z open, the release of relay 8A to close its back contact *a* is immaterial at this time. However, it will be noted that if relay 8A releases prior to the pick up of relay 6Z, the holding circuit including back contacts *a* of relays 8A and 6A and normal contact *a* of relay 6-8S will hold this latter relay in its normal position until relay 6Z picks up. When the first train, having moved through section 1T, accepts the proceed indication on signal 6G and enters track section 7T, relay 7TR releases in response to the detection of this train occupancy. Relay 6A is then reset or reenergized by the closing of back contact *a* of relay 7TR to complete the circuit further including front contact *a* of relay 7NWC. When relay 6A picks up, it opens its back contact *b* to deenergize relay 6Z which shortly releases but the route is already established and locked by the entry of the train into track section 7T. The closing of front contact *a* of relay 6A, together with the closing of back contact *a* of relay 6Z, completes the circuit for energizing the lower winding of relay 6-8S which operates its contacts to close in the reverse position.

The closing of reverse contact *b* of relay 6-8S completes the circuit, which was prepared when back contact *b* of relay 8A closed, for energizing relay 8Z which then picks up. Once again the opening of back contact *a* of relay 8Z interrupts the circuit network for the sequencing relay whose contacts then remain in their reverse positions. The closing of front contact *b* of relay 8Z prepares the various circuits for establishing a route for the train approaching through sections 4T and 2T but this route cannot be completed since section 7T is presently occupied and thus the route for the first train locked. However, as soon as this first train clears section 7T so that relay 7TR picks up, the control circuits for the switch will be completed and switch 7W is thus operated to its reverse position to prepare a route for the second train. Signal 8G will also clear to authorize a second train to move over the switch into the single track stretch as soon as the first train has advanced sufficiently far to provide a safe distance between the trains. When relay 7TR picks up and opens its back contact *a*, relay 6A of course remains energized over its normal circuit since it is presently assumed that front contacts *a* of relays 1TR and 3TR are closed.

However, if it is assumed that a following train enters section 3T prior to the first train clearing section 1T and with the second train moving through sections 4T and 2T, it will be noted that relay 6A will again release when it is deenergized by the opening of back contact *a* of relay 7TR, since its normal circuit is interrupted at front contact *a* of relay 3TR. With an automatic signal system in use and sections 1T and 3T, and 2T and 4T in the other branch, of sufficient length to provide braking distance, following trains may thus occupy the successive sections along each approach line. Even though this following train enters section 3T with the first train in section 1T, relay 6A will still be energized and picked up when the leading or first train enters section 7T. Thus with relay 8A released in response to the detection of the train in sections 2T and/or 4T, relay 6-8S will be operated to its reverse position in the manner previously explained. The route for the second train approaching through sections 4T and 2T will then be established as soon as section 7T is cleared by the first train. This is true since relay 6-8S is retained in its reverse position and relay 8Z thus remains energized to initiate and direct the establishment of the route over switch 7W in its reverse position and the clearing of signal 8G.

I shall now assume that a following train in the second branch enters section 4T before or as the second train passes signal 8G and enters section 7T. Relay 8A is reset by the circuit including back contact *a* of relay 7TR and front contact *a* of relay 7RWC which repeats the command and the positioning of switch 7W in its reverse position to establish the route for this second train. With back contact *b* of relay 8A thus opening, relay 8Z releases and the closing of its back contact *a* completes the circuit for the upper winding of relay 6-8S since front contact *a* of relay 8A has already closed. This causes relay 6-8S to operate its contacts to their normal positions and, with relay 6A released to close its back contact *b* in response to the following train approaching in the upper branch track, relay 6Z is again energized to prepare controls for a route from section 1T over the switch into the single track. Thus, following the movement of the second train from section 2T over the switch into the single track, the route for the following train in the upper branch is now established or at least prepared, in spite of the following train in the lower branch.

It is to be noted that, as shown in the regular circuits, relay 6-8S will be returned to its normal position, by front contact *a* of relay 8A, when the arrangement is completely at rest, i.e., no trains approaching or passing. If it is desirable to have relay 6-8S always remain in the position to which last operated until another train approaches, a back contact *c* of relay 6A may be inserted, as indicated by the dotted lines, between front contact *a* of relay 8A and the upper winding of relay 6-8S. This will not change the operation previously described but does allow relay 6-8S to remain in its reverse position if the last train of two or more successive trains enters the single track from the lower branch line (2T, 4T).

It is thus obvious that trains successively approaching the junction switch on both branches are alternately authorized to pass over the switch into the single track. In other words, even though sections 1-3T and 2-4T remain continuously occupied, the sequencing relay 6-8S is controlled to change position when each train enters the switch detector section 7T. Automatically then, without direct supervision or control by the system operator, the routes are established so that trains alternately converge from the two branch lines into the single track main line. This operation is accomplished efficiently and with a minimum of apparatus in an economical manner, yet full safety of the operation is maintained.

Although I have herein shown and described but one embodiment of the automatic control system for railroad interlocking to provide for the alternate movement of converging trains, it is to be understood that various changes and modifications may be made therein within the scope of the appended claims without departing from the spirit and scope of my invention.

Having now described the invention what I claim as new and desire to secure by Letters Patent, is:

1. A control arrangement for automatically alternating the passage of trains from two converging tracks through a track switch into a single track, comprising in combination, a. a first and a second approach relay coupled for registering the occupancy of the one or the other converging track, respectively, by an approaching train, b. train detector means coupled for detecting a train occupying a prefixed interlocking area where said tracks converge through said track switch into said single track, c. an indication means controlled by said switch for registering the established route condition, d. a sequencing means operable to a first and a second condition corresponding to one and the other converging tracks, respectively, e. route selection means controlled by said first and second approach relays and by said sequencing means and coupled for enabling the preparation of a route from one or the other converging track as an approaching train is detected in the corresponding track and said sequencing means operates to its corresponding condition, f. a reset circuit means controlled by said train detection means and said indication means and connected for resetting the approach relay, corresponding to the converging track on which a train, now detected in said prefixed interlocking area, approached, to a non-occupancy condition to register that train's passage into said single track, and g. an operating circuit means controlled by said first and second approach relays and connected for operating said sequencing means to a condition corresponding to a first approaching train registered occupying a particular converging track and to the other condition when passage of said first train into said single track is registered and a second approaching train is also registered occupying the other converging track.

2. A control arrangement as defined in claim 1 in which, said route selection means is also connected to said operating circuit means for inhibiting the operation of said sequencing means when a route is established.

3. A control arrangement as defined in claim 2 in which, a. said sequencing means is a two winding magnetic stick relay, and b. said operating circuit means comprises, 1. a first energizing circuit poled to operate said sequencing relay to its first condition and including a non-occupied position contact of the other converging track approach relay, one sequencing relay winding, and a circuit path controlled by said route selection means to be closed only when no route is established, 2. a second energizing circuit poled to operate said sequencing relay to its second condition and including an occupied condition contact of said other track approach relay, a non-occupied position contact of the one converging track approach relay, the sequencing relay other winding, and said closed route selection circuit path, 3. a first holding circuit for said one winding, poled to retain said sequencing relay in its first condition, including occupied position contacts of both approach relays, a first condition contact of said sequencing relay, and said closed route selection circuit path, and 4. a second holding for said other winding, poled to retain said sequencing relay in its second condition, including said occupied condition contacts of both approach relays, a second condition contact of said sequencing relay, and said closed route selection circuit path.

4. A control arrangement as defined in claim 3 in which, said first energizing circuit further includes in series an occupied position contact of said one track approach relay to enable said sequencing relay to hold in its existing position when both converging tracks are non-occupied.

5. In an automatic control system for a railroad interlocking, through which trains converge from two approach tracks through a track switch onto a single track, an arrangement for automatically alternating the movement of trains from the approach tracks, comprising in combination, a. a first and a second approach detection relay, each coupled for detecting the occupancy of the one and the other approach track, respectively, by an approaching train, b. a detector relay coupled to the rails within said interlocking limits and responsive to the passage of a train for registering the occupancy of the switch section, c. a switch position indicator coupled for indicating the position of the track switch selectively joining the approach tracks to said single track, d. a reset circuit network controlled by said detector relay and said switch position indicator and connected for selectively actuating each approach detection relay to a non-occupancy position when a train from the corresponding approach track occupies the switch section, e. a sequencing relay operable between a first and a second position in accordance with the actuating energy applied, f. route control means controlled by said approach detection relays and by said sequencing relay for alternately initiating the establishment of routes from each track when approaching trains are successively detected and said sequencing relay alternately operates between its first and second positions, each route being finally established when a preceding train completes its passage into said single track, and g. a control circuit network controlled by said approach detection relays and said route control means and connected for operating said sequencing relay alternately between its first and second positions when trains are successively detected in each approach track, said approach detection relays are reset by passage of each train through said interlocking limits, and the existing established route is cancelled.

6. A control system arrangement as defined in claim 5 in which said route control means comprises, a. a first and a second route relay associated with the one and the other approach track, respectively, and coupled for initiating when activated the establishment of a route from the associated track into said single track, and b. an energizing circuit for each route relay including, 1. a contact of said sequencing relay closed when the sequencing relay position corresponds to the approach track associated with that route relay, and 2. a contact closed when the corresponding approach relay detects a train occupying that approach track.

* * * * *